United States Patent [19]

Shapiro

[11] Patent Number: 4,583,369

[45] Date of Patent: Apr. 22, 1986

[54] SYSTEM FOR DETECTING TUBING RUPTURE IN FEEDWATER HEATERS OF STEAM POWER PLANT

[75] Inventor: Mark A. Shapiro, Southfield, Mich.

[73] Assignee: Factory Mutual Research Corporation, Norwood, Mass.

[21] Appl. No.: 732,297

[22] Filed: May 9, 1985

[51] Int. Cl.[4] ..... F01K 19/00

[52] U.S. Cl. ..... 60/657; 60/646; 60/660

[58] Field of Search ..... 60/646, 657, 660, 678

[56] References Cited

U.S. PATENT DOCUMENTS 3,135,096 6/1964 Schroedter ..... 60/646

4,003,205 1/1977 Matsumura ..... 60/646

4,020,488 4/1977 Martin et al. ..... 340/412

*Primary Examiner*—Stephen F. Husar

*Attorney, Agent, or Firm*—Lane and Aitken

[57] ABSTRACT

In a steam power plant, a system is provided for early detection of a rupture or extensive leak from the feedwater tubing in the feedwater heaters. The system senses the temperature and pressure in the steam space of each feedwater heater. A pressure rise followed by a temperature drop in the steam space of a feedwater heater is recognized as being caused by a rupture or extensive leak in the feedwater heater and in response to such occurrance, an alarm is activated and a power assisted check valve is closed in the extraction line feeding extraction steam from the turbine to the feedwater heater.

9 Claims, 2 Drawing Figures

SYSTEM FOR DETECTING TUBING RUPTURE IN FEEDWATER HEATERS OF STEAM POWER PLANT

This invention relates to a system in a steam power plant for detecting the presence of a rupture or intensive leakage from the interior tubing of a feedwater heater and to sound an alarm, and/or positively close valves to prevent damage to the steam turbine of the power plant.

One of the more common causes and the costliest type of failure in a steam failure occurs when water or wet steam is inducted into the turbine from the extraction lines of the turbine. The water induction occurs as a result of rupture or extensive leakage from the interior tubing in a feedwater heater into the steam space of the feedwater heater. When a rupture of this tubing occurs, or when extensive leakage occurs, the pressure within the steam space will rapidly increase to cause a reverse flow of the wet steam from the heater toward the turbine through the extraction line. Check valves are usually employed to prevent such reverse flow, but the wet steam flowing in the reverse direction through the extraction line will have a considerably lower temperature than the extraction steam previously flowing in the extraction line in the forward direction. This drop in temperature can cause a cold temperature shock to the check valve and binding of mechanical parts of the check valve, particularly if there is some corrosion in the valve. As a result, wet steam may be allowed to enter the turbine and cause severe damage to the turbine blades.

Prior to the present invention, it has been proposed to overcome this problem by detecting when a leak or rupture has occurred in a feedwater heater by sensing an abnormally high level of water in the feedwater heater and sounding an alarm, and/or closing a valve in the extraction line, when this occurs. However, such systems have not proved effective in preventing turbine damage when a rupture occurs because by the time the water level in the feedwater heaters reaches an abnormally high level, wet steam from the feedwater heater, in many instances, will have already passed into the turbine through the extraction line.

When a rupture of the tubing inside of a feedwater heater occurs, the first thing that happens is that the steam pressure increases almost instantly because the feedwater, which flows through the tubing of the feedwater heater will be at a pressure several times higher than that of the steam space. When the feedwater enters the steam space, as a result of rupture or leakage, the difference in pressures causes the feedwater to flash into wet steam and causes a rapid pressure build up in the steam space. As pointed out above, it is this increase in pressure which causes the reverse flow of wet steam toward the turbine through the extraction line. The steam temperature at the local area where the leak or rupture occurred in the feedwater heater will drop abruptly because of the lower temperature of the feedwater in the interior tubing. As the feedwater continues to flood into the steam space, the steam temperature will also drop throughout the entire steam area of the feedwater heater. The temperature of the steam condensate within the feedwater heater will drop not only because of the mixing of the lower temperature wet steam with the condensate, but also because the pressure build up within the steam space prevents the extraction steam with a higher temperature from entering into the feedwater heater. The level of the condensate within the feedwater heater will initially drop because it is pushed down by the rapid pressure build up in the steam space of the heater and this rapid pressure build up prevents the condensate from a higher pressure feedwater heater from entering into the flooded feedwater heater. On the other hand, the water level in the other feedwater heaters, having their condensate drains connected in series, will tend to increase. Only after a considerable amount of time, does the water level in a feedwater heater with ruptured tubing increase, when the wet steam and feedwater pressure become equalized.

Accordingly, when a rupture in the interior tubing of the feedwater heater occurs, the first indication of this condition would be an increase in the steam pressure in the steam space of the flooded heater. The second indication would be a steam temperature drop in the steam area of the flooded heater. The third and fourth indications would be a level and temperature drop of the steam condensate in the flooded heater. The next indication would be an increase in the condensate level in the feed water heaters upstream and downstream from the flooded heater. The last indication would be an increase in the water level in the flooded heater.

As indicated above, early detection of a tube rupture in a feedwater heater is vital in order to give operators time to take corrective action to prevent damage to the turbine. One technique presently employed to detect tube rupture in a feedwater heater is to employ a water level detector in the feedwater heater. When the water level gets excessively high, the system activates an alarm. However, as pointed out above, when a tube rupture in a feedwater heater occurs, the water level initially drops instead of rising and accordingly the operators are given no alarm at the time of the rupture. On the other hand, alarms on the feedwater heaters preceeding or following the flooded heater may occur, but these alarms will present wrong information to the operator and not clearly indicate which heater has the rupture.

In addition to detecting the water level in the feedwater heaters, some turbine power plants are equipped to monitor the feedwater temperature before and after the feedwater heaters. Such temperature monitors however, will not provide a reliable indication of a rupture because the feedwater temperatures decrease resulting from a tubing rupture in a feedwater heater will occur well after the steam area of the feedwater heater is filled with wet steam. In some power plants, operators take hourly readings of the extraction steam and feedwater parameters. This practice, however, fails to provide a reliable early detection of a flooded heater. In some steam power plants, water detection thermocouples are installed in the casings of the high pressure and intermediate pressure stages of the turbine at each location of a steam inlet or an extraction line. These thermocouples however, fail to provide a satisfactory safety device to prevent damage due to rupture in a feedwater heater because they indicate when water has already entered the turbine.

Some modern power plants have the turbines equipped with temperature and pressure monitors on the extraction lines. Such monitors however, will not provide an early indication of tube rupture in a feedwater heater because conditions in the feedwater heaters have to stabilize before the reading of the extraction line parameters will provide a reliable indication. Modern turbines are often equipped with a temperature monitor in the steam space of feedwater heaters, but such temperature monitors will not by themselves provide an indication of a rupture of the tubing in a feedwater heater, since for example, a drop in the turbine load will result in a temperature drop in the feedwater heaters.

SUMMARY OF THE PRESENT INVENTION

These shortcomings of the prior art systems and techniques employed in present systems to attempt to avoid turbine damage due to a rupture in the feedwater heater are overcome in the present invention by providing a much earlier signal indication that a rupture or extensive leak has occurred in a feedwater heater. This signal can be used to actuate an alarm and/or close a power assisted check valve in the extraction line leading to the heater. In accordance with the present invention a comparison and monitor circuit detects when the combination of at least two different parameters changes occur, which changes occur uniquely with a rupture or leak in a feedwater heater. As pointed out above, when a rupture occurs, a rapid increase in pressure will occur in a steam space of the feedwater heater. In addition, a drop in temperature will occur. In accordance with the present invention both the pressure and the temperature are sensed in the steam area of the feedwater heater. The comparison and monitor circuit determines when both the condition of a pressure rise and a temperature drop occurs in the steam area. When these two conditions occur together, this means that a rupture has occurred, and the monitor and comparison circuitry actuates an alarm and applies a signal to a power assisted check valve in the extraction lines to ensure closing of a check valve before the wet steam is allowed to enter the turbine. In this manner, extensive damage to the turbine by the reverse flow of wet steam from a feedwater heater with ruptured tubing through the extraction line into the turbine is prevented.

DESCRIPTION OF THE PREFERRED EMBODIMENT

Figure 1:
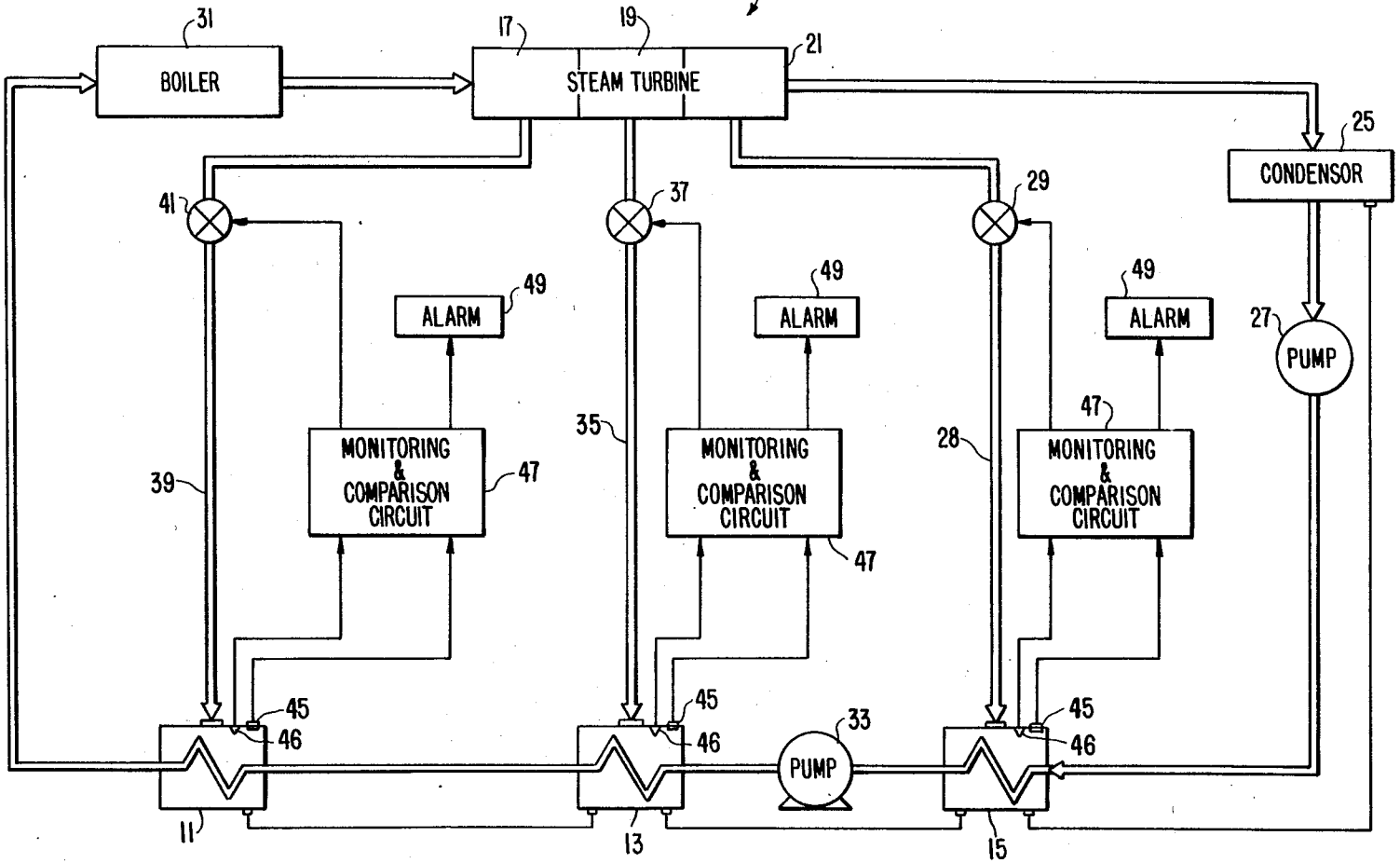
FIG. 1 is a block diagram of a steam power plant incorporating the present invention.

The steam power plant, illustrated by the block diagram of FIG. 1, has been greatly simplified for purposes of reducing the complexity of the disclosure and to facilitate understanding of the invention. For example, in FIG. 1 the power plant is shown with only three feedwater heaters 11, 13 and 15 connected to receive extraction steam from the high pressure stage 17, the intermediate pressure stage 19, and the low pressure stage 21 of the steam turbine 23, whereas most power plants will have seven or more feedwater heaters including three or more feedwater heaters, each connected to receive extraction steam through a separate extraction line from the intermediate pressure stage of the steam turbine, and three or more feedwater heaters, each connected to receive extraction steam through a separate extraction line from the low pressure stage of the steam turbine. In addition, the steam connections and water line connections of the power plant may take many different variations and will usually be substantially more complex than that shown in FIG. 1, although they will for the most part, all involve the same components, that is a boiler, a condenser, feedwater heaters, and feedwater pumps.

In a simplified system, shown in FIG. 1, the exhaust steam from the turbine 23 is led into a condenser 25 where the exhaust steam is condensed into water and then is pumped by a feedwater pump 27 into the interior tubes of the feedwater heater 15, where the feedwater is heated by extraction steam bled from the low pressure stage 21 of the turbine 23. Extraction steam travels from the low pressure stage through extraction line 28 and power assisted check valve 29 in the extraction line 28 to the steam space within the outer shell of the feedwater heater 15. The feedwater, after passing through the interior tubing of the feedwater heater 15, then passes through the interior tubing of the feedwater heater 13 and feedwater heater 11 to the boiler 31. A booster pump, such as the pump 33, may be provided in the feedwater line between the feedwater heaters 13 and 15. Alternatively, or in addition to the pump 33, a boiler feedwater pump may be provided between the feedwater heaters 11 and 13. Extraction steam from the intermediate pressure stage 19 of the turbine flows through extraction line 35 and power assisted check valve 37 in the extraction line 35 to the steam space within the outer shell of the feedwater heater 13. Extraction steam from the high pressure stage of the steam turbine 23 flows through extraction line 39 and power assisted check valve 41 in extraction line 39 to the steam space within the outer shell of the feedwater heater 11. The power assisted check valves 29, 37 and 41 allow steam flow from the turbine 23 to the feedwater heater 15, 13 and 11 respectively, but are supposed to close in response to any tendency of reverse flow through the respective extraction lines 28, 35 and 39. They also may be closed by electrical power in response to an applied signal.

The feedwater heater 11 has a drain for condensate of the extraction steam collected in the feedwater heater and this drain is connected to a condensate inlet in the bottom of the feedwater heater 13. A condensate drain in the feedwater heater 13 is connected to a condensate inlet in the feedwater heater 15, which has a condensate drain connected back to the condenser 25. With this arrangement, the condensate collected in each of the feedwater heaters will flow back to the condenser 25 under the force of the steam pressure in each of the feedwater heaters.

Each of the feedwater heaters has a temperature sensing transducer 46 sensing the temperature in the steam space at the top of the feedwater heater and a pressure sensitive transducer 45, sensing the pressure in the steam space of the feedwater heater. The temperature signal from the temperature transducer 46 and the pressure signal from the pressure transducer 45, from each feedwater heater are applied to a corresponding monitoring and comparison circuit 47. Each monitoring and comparison circuit monitors the two applied signals and detects the occurance of a rise in pressure in the steam space of the corresponding feedwater heater followed a short interval later, e.g. one (1) minute, by a temperature drop sensed by the temperature transducer 46 in the corresponding feedwater heater. When both of these conditions occur, this means that the feedwater tubing within the feedwater heater has ruptured or has a massive leak of the feedwater into the steam space. Accordingly, when the monitoring and comparison circuit 47 detects this condition, it activates an alarm 49 and applies a signal to the one of the power assisted check valves 41, 37 and 29 corresponding to the feedwater heater, in which the condition is detected. The power assisted check valve, in response to receiving the signal, is actuated to a closed position. In this manner, an early alarm of a rupture of the feedwater tubing in a feedwater heater, or a massive leak in the tubing of the feedwater heater, is detected and an alarm is activated to alert the operator. In addition, a check valve in the extraction line is caused to be automatically closed to prevent the reverse flow of the wet steam from the malfunctioning feedwater heater through the extraction line into the steam turbine. The signal applied to the check valve will cause it to close before it receives the thermal shock from the colder wet steam tending to flow in the reverse direction through the check valve and thus, the thermal shock does not interfere with the closing of the check valve.

Figure 2:
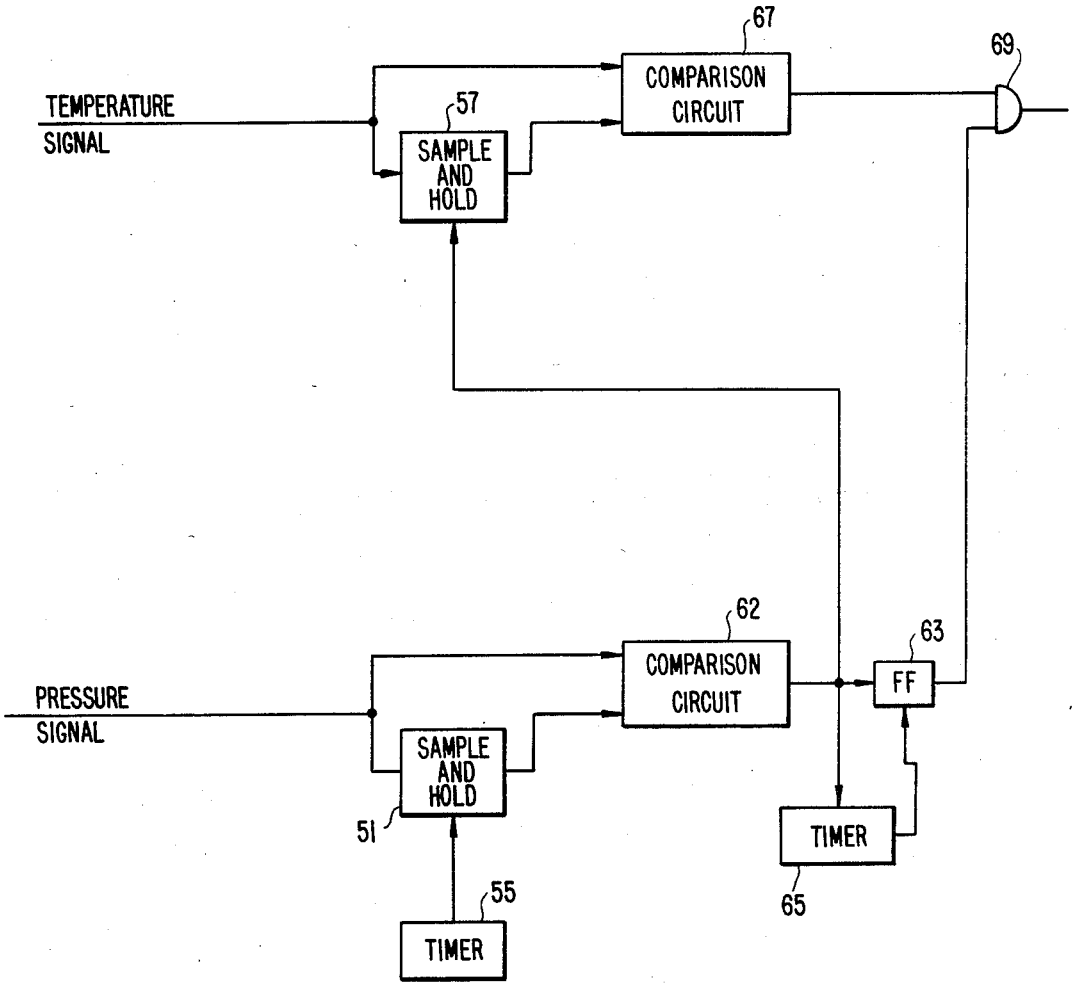
FIG. 2 is a block diagram illustrating the details of the comparison and monitoring circuit used in the system of the present invention.

FIG. 2 is a block diagram illustrating the details of an example of the circuit which could be used for one of the monitoring and comparison circuits 47, each of the circuits being identical. As shown in FIG. 2, the pressure signal from the pressure sensitive transducer 45 is applied to a sample-and-hold circuit 51, which is periodically enabled to receive and store the applied signal by a timer 55 once every second. When the sample-and-hold circuit 51 is enabled, it stores the amplitude of applied signal and then continues to transmit the stored signal to its output. The temperature signal from the temperature sensitive transducer 46 is applied to a sample-and-hold circuit 57. When the sample-and-hold circuit 57 is enabled, it will store the amplitude of the applied signal and then continue to transmit the stored signal to its output.

The output of the sample-and-hold circuit 51 is applied to a comparison circuit 62, which also receives the signal from the pressure transducer and determines if the output signal from the pressure transducer represents a pressure 10 pounds per square inch greater than the output signal from the sample-and-hold circuit 51. If such a difference in the two signals is detected by the comparison circuit 62, it will apply a signal to a flip flop 63 to set the flip flop 63. Thus, if the pressure signal, produced by the pressure sensitive transducer rises by 10 pounds per square inch in the one second time interval after the sample-and-hold circuit 51 is enabled by the timer 55, the comparison circuit 62 will set the flip flop 63. After a period of one (1) minute, the flip flop 63 will be reset by a timer 65, which is also triggered by the output signal from comparator 62.

The output signals from the sample-and-hold circuit 57 is applied to a comparison circuit 67, which compares the output signal from the sample-and-hold circuit 57 with the output signal from the temperature transducer. If the temperature represented by the output signal of the temperature transducer drops below the temperature, represented by the output signal of the sample-and-hold circuit 57 by more than five degrees Fahrenheit, the comparison circuit 67 will detect this condition and apply an enabling signal representing this condition to an AND gate 69. When the comparison circuit 62 detects a 10 p.s.i. rise in pressure, it applies a signal to the sample-and-hold circuit 57 to enable it and cause it to store the applied temperature signal. Thus, the comparison circuit 67 will apply an enabling signal to the AND gate 69 whenever the temperature signal from the temperature sensing transducer 46 represents a drop in temperature of 5 degrees following detection of a 10 p.s.i. pressure rise by comparator 62. When the flip flop 63 is set by the comparison circuit 62, it also applies an enabling signal to the AND gate 69. When the AND gate 69 receives enabling signals from both the flip flop 63 and from the comparison circuit 67, it produces an output signal indicating that a rupture has occurred or a massive leak has occurred in the corresponding feedwater heater.

As explained above, when a rupture occurs in a feedwater heater, the first thing that happens is that the pressure in the steam space of the feedwater heater immediately rises. Accordingly, the output signal from the pressure transducer will rise above the output signal from the sample-and-hold circuit 51. As a result, the comparison circuit 62 will produce an output signal and set the flip flop 63, which then will apply an enabling signal to the AND gate 69. In addition, the sample-and-hold circuit 57 will be enabled to store temperature sensed by the temperature sensing transducer. The temperature sensed by the transducer will begin to drop and within a period of than one (1) minute, the comparison circuit 67 will detect that the temperature transducer is producing an output signal representing more than five (5) degrees less than the temperature represented by the output signal of the sample-and-hold circuit 57. Accordingly, the comparison circuit 67 will apply an enabling signal to the AND gate 69. The flip flop 63 will still be applying an enabling signal to the AND gate 69, since it will not yet be a reset by the timer 65 and accordingly the AND gate 69 will produce an output signal to activate the alarm 49 and to cause the corresponding power assisted check valve 29, 37, or 41 to close.

In this manner, the system of the present invention detects a unique set of conditions in the feedwater heater occurring when the feedwater tubes in the feedwater heater rupture, or an extensive leak from the feedwater tubes occurs, that is an immediate pressure rise of at least 10 pounds per square inch followed by a temperature drop within one minute of at least five degrees. When these two conditions occur, this means that a rupture has occured and the system activates an alarm and causes the check valve in the corresponding extraction line to be closed, thus, preventing extensive damage to the turbine.

The circuit shown in FIG. 2 is just one example of a circuit which can be employed to carry out the monitoring and comparison function and it will be recognized that this circuit can take many other forms. For example, a microprocessor could be used to carry out the function digitally. In addition, while as explained above, the pressure rise coupled with the temperature drop provide the earliest reliable indication of a rupture or leak in the feedwater heater, other combinations of different parameters could be detected in addition to or instead of these parameters. The above description is of a preferred embodiment of the invention and modification may be made thereto without departing from the spirit and scope of the invention, which is defined in the appended claims.

What is claimed is:

1. In a steam power plant comprising a steam turbine, means to supply steam to said turbine including at least one feedwater heater comprising an outer shell and tubing to carry feedwater through said outer shell, means to introduce extraction steam from said turbine into said outer shell to heat the feedwater in said tubing, the improvement comprising means to detect a predetermined combination of a plurality of different parameter changes that occur when feedwater leaks from said tubing into the steam space within said outer shell and to generate when said combination of plurality of parameter changes occur a signal indicating that feedwater is leaking from said tubing into said steam space.

2. In a steam power plant, as recited in claim 1, wherein said means to introduce extraction steam into said shell of said feedwater heater comprises an extraction line connected between said turbine and said shell and a valve in said extraction line, the improvement further comprising means to close said valve in response to said signal.

3. In a steam power plant, as recited in claim 2, wherein said valve comprises a power assisted check valve connected to be closed in response to said signal.

4. In a steam power plant, as recited in claim 1, wherein said changes in parameters comprise a rise in pressure in the steam space in said feedwater heater and a drop in temperature in said steam space in said feedwater heater.

5. In a steam power plant, as recited in claim 1, wherein said combination of parameters comprise a predetermined rise in pressure in the steam space in said feedwater heater followed by a predetermined drop in temperature in said steam space in said feedwater heater.

6. In a steam power plant, as recited in claim 1, wherein said combination of changes in parameters consist of a rise in pressure in the steam space of said feedwater heater and a drop in temperature in the steam space of said feedwater heater.

7. In a steam power plant, as recited in claim 1, wherein said combination of parameters consist of a predetermined rise in pressure in the steam space of said feedwater heater followed by a predetermined drop in temperature in the steam space of said feedwater heater.

8. In a steam power plant comprising a steam turbine, means to supply steam to said turbine including a plurality of feedwater heaters, each including an outer shell and tubing to carry feedwater through said outer shell, said tubing and said outer shell defining a steam space in each of said feedwater heaters, and means to introduce extraction steam from said turbine into the steam space of each of said feedwater heaters, the improvement comprising means for each of said feedwater heaters to detect a predetermined combination of different parameter changes that occur when feedwater leaks from said tubing into the steam space within said outer shell and to generate, when said combination of parameter changes occur, a signal indicating that feedwater is leaking from the tubing of such feedwater heater into the steam space of such feedwater heater.

9. In a steam power plant, as recited in claim 8, wherein said means to supply extraction steam from said turbine into the steam space of each of said feedwater heaters comprises for each of said feedwater heaters an extraction line connected between said turbine and said feedwater heater and a corresponding valve in the extraction line, the improvement further comprising means responsive to the signal generated to indicate leakage in one of said feedwater heaters to close the valve in the extraction line connected between such feedwater heater and said turbine.

* * * * *